US006032486A

United States Patent [19]

Uchin

[11] Patent Number: 6,032,486

[45] Date of Patent: Mar. 7, 2000

[54] REVERSIBLE JEWELRY

[76] Inventor: Alan Uchin, 915 Spring Garden St. Studio 108, Philadelphia, Pa. 19123

[21] Appl. No.: 09/012,271

[22] Filed: Jan. 23, 1998

[51] Int. Cl.[7] ..... A44C 17/02

[52] U.S. Cl. ..... 63/31; 63/40; 63/12

[58] Field of Search ..... 63/1.11, 1.16, 63/1.17, 12, 13, 40, 31

[56] References Cited

U.S. PATENT DOCUMENTS

| | | | |
|---|---|---|---|
| 249,201 | 11/1881 | Oliver . | |
| 2,682,759 | 7/1954 | Chalikian et al. . | |
| 3,613,393 | 10/1971 | Lamoureux | 63/31 X |
| 4,726,200 | 2/1988 | Carter | 63/31 X |
| 5,020,339 | 6/1991 | Cardena | 63/31 X |
| 5,622,061 | 4/1997 | Sakata | 63/13 X |

*Primary Examiner*—Terry Lee Melius
*Assistant Examiner*—William L. Miller
*Attorney, Agent, or Firm*—Donald R. Johnson

[57] ABSTRACT

A novel pierced-ear earring comprises a toggle having inner and outer sides and an earpost attached to the inner side. A perforation passes through two other sides of the toggle, and an upper portion of a loop is positioned within the perforation. A pendant having first and second faces comprising non-identical ornaments is attached to a lower portion of the loop. The loop and pendant are rotatable through 180 degrees about the axis of the perforation and, together with the toggle and earpost, are rotatable through 180 degrees about the axis of the earpost. A novel method of reversing the novel earring comprises rotating the entire earring about the axis of the earpost and simultaneously rotating the loop and pendant about the axis of the toggle perforation. The earpost, toggle and loop comprise a novel finding or component for use in manufacture of jewelry.

3 Claims, 2 Drawing Sheets

REVERSIBLE JEWELRY

BACKGROUND AND PRIOR ART

The present invention pertains to jewelry components or "findings "and particularly to components for attaching reversible ornamentation in a jewelry design.

The jewelry industry is diverse and characterized by intense competition. Novelty of function as well as design is an important selling point, but manufacturers and consumers have not been exposed to anything truly unique in a long time. The industry is ready and eager for functional, affordable designs that will be a creative addition to a stagnant pool of findings and finished goods.

Reversible jewelry capable of alternately displaying non-identical designs on two faces thereof provides such a creative addition, the element of recognition sought in developing successful promotions, and a marketing advantage that translates into greater profit potential immediately and over the long term. The duality of design made possible by reversible jewelry opens limitless design possibilities.

Reversible components of the prior art have disadvantages, including (1) requiring reversible ornaments to operate independently of the component, (2) requiring interruption of use of the jewelry to reverse the ornaments, (3) requiring removal of the ornaments from the component in order to reverse the ornaments, and/or (4) requiring tools for repositioning of the reversed ornaments.

There remains a need for a component that can provide permanent affixation of reversible ornaments to component and easy manipulation of component to securely reposition the reversible ornament, without restriction of the design function of the jewelry and without use of any tools.

REVERSIBLE JEWELRY GENERICALLY ACCORDING TO THE INVENTION

Reversible jewelry according to the invention comprises:

(1) a body-engaging part comprising an earpost, (2) a double-faced pendant having two non-identical ornamental faces and (3) a toggle-and-loop reversing component connecting the body-engaging part with the pendant.

BODY-ENGAGING PART

The body-engaging part of jewelry according to the invention is a conventional earpost.

PENDANT

The pendant portion of jewelry according to the invention has two non-identical ornamental faces, a purpose of the invention being to enable the two faces to be alternately displayed to a viewer who typically sees only the outer face of the pendant. The reversing component subsequently described reverses the two faces of the pendant, so that either face may be displayed to the viewer according to the desire of the wearer.

Where "double-faced" pendants are referred to herein, it is understood that the two faces are both ornamental and are different from each other. Different-colored stones, or different designs, may for example be displayed on the two faces.

One of the non-identical faces of the pendant, is the outer or viewer-side face; in a pierced-ear earring, this face is on the opposite side of the earring from the earpost. The other face of the pendant is the inner or wearer-side face; in a pierced-ear earring, this face is on the same side of the earring as the earpost.

TOGGLE-AND-LOOP REVERSING COMPONENT

The reversing component in the earring of the invention comprises (a) a perforated toggle and (b) a loop of rigid material (i) having an upper portion positioned within the toggle perforation and (ii) rotatable through at least 180 degrees, and typically through 360 degrees, about the axis of the toggle perforation.

The invention comprises in one embodiment the toggle-and-loop reversing component per se, useful in making reversible pierced-ear earrings.

TOGGLE

The toggle of the reversing component in the earring of the invention is typically elongated and has two ends and four sides, through two of which sides the above-mentioned perforation passes. An earpost in this embodiment typically extends at a ninety degree angle from a third side of the toggle.

Other toggle shapes which may be used in jewelry according to the invention include without limitation substantially cubical shapes with the perforation through two opposite sides of the cube, elongated lozenge shapes with the perforation through two opposite sides of the lozenge and pyramidal shapes with the perforation through two opposite sides of the pyramid.

The length and shape of the toggle can vary over a wide range, but the loop is long enough to allow the toggle to flip over freely, that is, rotate 180 degrees about the axis of the perforation in the toggle, as subsequently more full described.

LOOP

The loop portion of toggle-type articles according to the invention may be considered part of the pendant portion of the article, since the loop is rigidly affixed to the pendant and rotates as a unit with the pendant. Alternatively, the loop and pendant may be considered separate parts which are rigidly affixed to each other so they rotate as a unit.

The upper portion of the loop has a wire portion which passes through the perforation in the toggle, the two sides of the loop then curving around and down approaching each other. In this embodiment, the loop comprises an inverted U shape, with the lower ends of the inverted U brought together and soldered to each other and to a double-faced pendant.

Alternatively, an inverted U shaped loop can be used in which the lower ends are not brought together but are individually soldered to each of the two sides of a double-faced pendant. A variation of the latter shape may be used in which the upper corners of an inverted U are squared off to provide a generally rectangular shape to the loop, with the lower open ends of the rectangle being individually soldered to each of the two sides of a double-faced pendant.

Other loop shapes which may be used in jewelry according to the invention include without limitation generally triangular shapes with the "base"of the isosceles triangle passing through the perforation in the toggle and the equal sides of the triangle extending down toward a point, the pendant portion of the jewelry again being affixed to the lower end of the loop. The loop may alternatively be of generally circular or oblong shape.

The loop may be made of rigid metal or plastic wire, for example 18-gauge wire, or other suitable material.

TOGGLE-AND-LOOP PENDANT-REVERSING METHODS

The invention also comprises methods for reversing the pendant of earrings according to the invention which have (a) an upper portion comprising (i) a perforated toggle and (ii) an earpost affixed at one end to, and extending at a right angle from, a side of the toggle and (b) a lower portion comprising (i) a loop passing through the toggle perforation and (ii) a double-faced pendant affixed to the loop.

REVERSAL BY 180-DEGREE RELATIVE ROTATION OF UPPER AND LOWER PORTIONS OF PIERCED-EAR EARRING

One such method comprises reversing the pendant by rotating the upper earpost-and-toggle portion and the lower loop-and-pendant portion through 180 degrees of arc relative to each other about the axis of the toggle perforation.

Such reversal of the pendant may be accomplished by (1) rotating the upper portion of the earring about the lower portion 180 degrees, or (2) rotating the lower portion of the earring about the upper portion 180 degrees, or (3) any combination of rotations of both portions which result in a 180 degree rotation of the portions relative to each other.

In this method, the 180-degree rotation or rotations (1) cause the ends of the toggle to be reversed in relation to the loop and pendant, and (2) cause the faces of the pendant to be reversed in relation to the earpost affixed at one end to, and extending at a right angle from, a side of the toggle.

This method is feasible only when the earring is not being worn. In other words, to reverse by this method the pendant faces of an earring which is being worn, the earring is removed from the ear, the pendant is reversed, and the earring is put back in the ear.

ADDITIONAL ROTATION OF PIERCED-EAR EARRING ABOUT AXIS OF EARPOST

In another such method, in addition to (1) rotating the lower portion of the earring through 180 degrees about the axis of the toggle perforation, (2) a second rotation is performed, of the entire earring as a unit 180 degrees about the axis of the earpost. The two rotations may be performed sequentially in either order, but more typically are performed simultaneously. This method may be performed with the earring either in or out of the ear of the wearer.

SIMULTANEOUS ROTATIONS OF COMPONENTS OF PIERCED-EAR EARRING ABOUT TWO DIFFERENT AXES

Simultaneous rotations of (1) the lower portion of a pierced-ear earring according to the invention about the axis of the toggle perforation and (2) the entire earring about the axis of the earpost are more fully described in reference to FIGS. 8 to 13 of the drawings.

SEQUENTIAL ROTATIONS OF COMPONENTS OF PIERCED-EAR EARRING ABOUT TWO DIFFERENT AXES

Sequential rotations of (1) the lower portion of a pierced-ear earring according to the invention about the axis of the toggle perforation and (2) the entire earring about the axis of the earpost may for example comprise, starting with a pierced-ear earring in normal wearing position, with the outer face of the pendant a faceted stone, (1) rotating the lower loop-and-pendant portion of the earring upwardly 180 degrees about the axis of the toggle perforation out of normal wearing position into a position in which the loop and pendant are above the toggle, then (2) rotating the entire earring including the upper toggle-and-earpost portion of the earring and the lower pendant-and-loop portion of the earring, down 180 degrees about the axis of the earpost to bring the earring again into normal wearing position, but now with a smooth stone the outer face.

The same overall result as just described may be obtained by reversing the order of the two rotations, in which case the first step is 180 degree upward rotation of the upper portion of the earring about the axis of the earpost, followed by 180 degree downward rotation of the lower portion of the earring to reverse the inner and outer faces of the pendant.

UTILITY OF REVERSING COMPONENTS AND REVERSIBLE JEWELRY

The reversing components of the invention are singular in design and can be used by large manufacturers, small businesses, and individuals, in multiple applications without costly equipment modification or use of special tools.

The reversing component provides an elegant solution to the problem of simply and effectively attaching and repositioning reversible ornamentation. The component's simplicity in manipulation encourages its use in jewelry design, and the ease and inexpensiveness of manufacture of the component allows accessibility to all levels of jewelry producers.

DETAILED DESCRIPTION OF THE DRAWINGS

Figure 1:
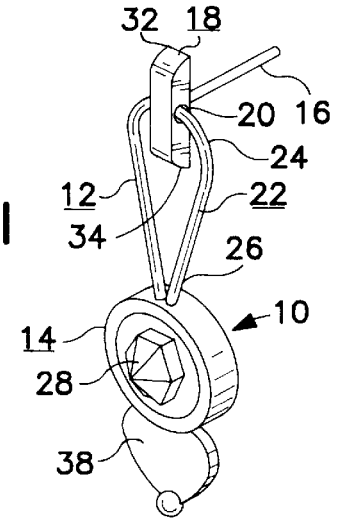
FIG. 1 is an enlarged isometric view of a pierced-ear earring comprising a toggle reversing component, the toggle having an inner side and an outer side with respect to the body of the wearer, and having an earpost attached to its inner side, the earring comprising a pendant having an inner face and an outer face of different design, the outer face being as seen in FIG. 1, a small hexagonal faceted stone.
Figure 2:
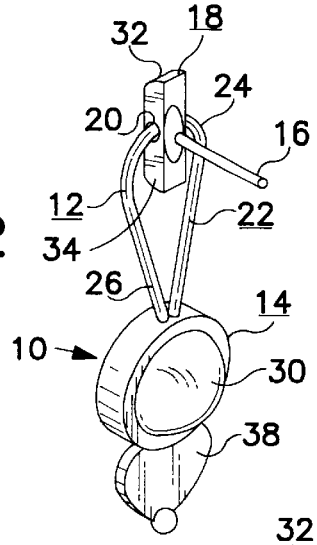
FIG. 2 is a view similar to FIG. 1 but showing the inner face of the pendant to be a smooth stone generally in the shape of a portion of a sphere.
Figure 4:
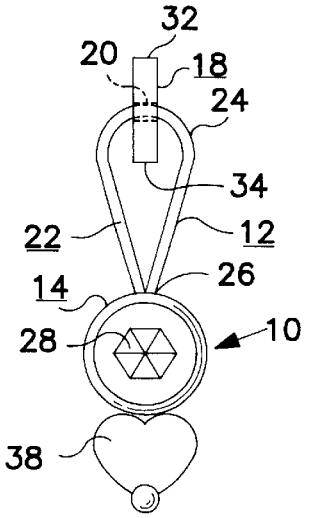
FIG. 4 is a front elevational view of the earring of FIGS. 1 to 3.
Figure 3:
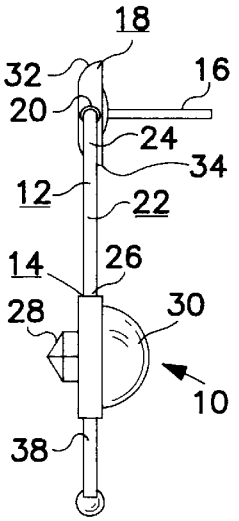
FIG. 3 is an enlarged side elevational view of FIG. 1.
Figure 5:
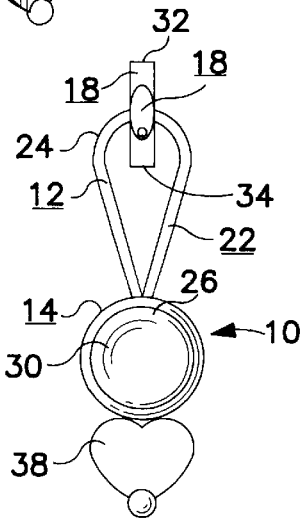
FIG. 5 is a rear elevational view of the earring of FIGS. 1 to 4.

In FIGS. 1 to 7, 10 is a pierced-ear earring for the left ear comprising earpost 16, reversing component 12 and double-faced pendant 14.

Reversing component 12 comprises toggle 18 having perforation 20 therethrough, and a connector comprising wire loop 22 having upper portion 24 positioned in part within perforation 20 and having lower portion 26 affixed to pendant 14.

Pendant 14 has faceted stone face 28 and smooth stone face 30. Heart-shaped ornament 38 is affixed to pendant 30.

In the position shown in FIGS. 1 to 5, faceted stone face 28 is the outer face of pendant 14 and smooth stone face 30 is the inner face of pendant 14.

Figure 6:
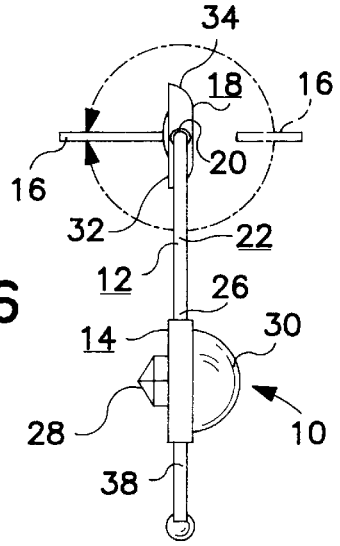
FIG. 6 is a side elevational view similar to FIG. 3 but showing the post and toggle rotated 180 degrees, reversing the position of the inner and outer faces of the pendant with respect to the earpost.
Figure 7:
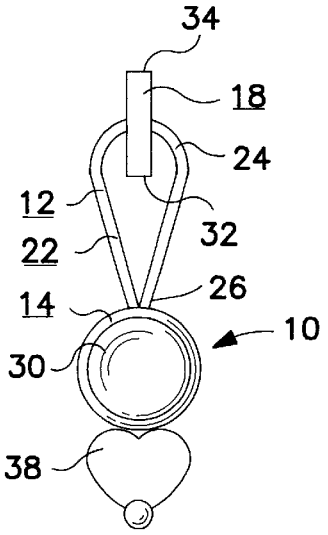
FIG. 7 is a front elevational view of the earring of FIGS. 1 to 6 after rotation as shown in FIG. 6, the outer face now being the smooth stone which prior to rotation was the inner face.

In the position shown in FIG. 7, the faces of pendant 14 are reversed, toggle 18 and post 16 having been rotated 180 degrees as indicated in FIG. 6 so that smooth stone face 30 has become the outer face of pendant 14 on the opposite side of earring 10 from earpost 16, and faceted stone face 28 has become the inner face of pendant 14.

Toggle 18 has an end 32 which is the upper end of the toggle in the position of earring 10 as shown in FIGS. 1 to 5, and has an end 34 which is the lower end of the toggle in the position of earring 10 as shown in FIGS. 1 to 5. After rotation of earring 10 as shown in FIG. 6, end 32 has become the lower end of toggle 18 and end 34 has become the upper end of toggle 14.

The reversal of faces 28 and 30 of pendant 14 may be accomplished by methods illustrated in FIGS. 8 through 13 and by other methods disclosed subsequently.

Figure 8:
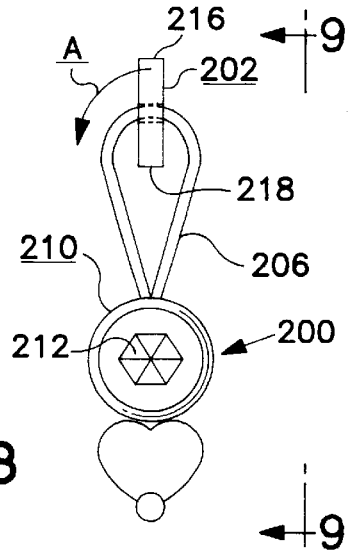
FIGS. 8 and 9 are front and side elevational views of a pierced-ear earring having an earpost attached to its inner side and comprising a toggle reversing component, and a pendant having an inner face and an outer face of different design, the outer face being a small hexagonal faceted stone and the inner face a smooth stone.
Figure 9:
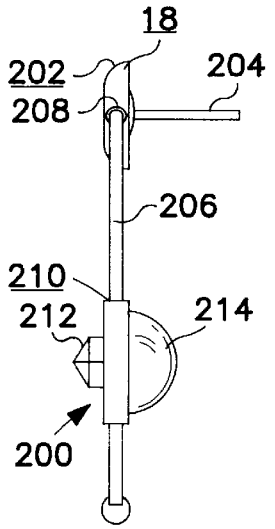

In FIGS. 8 and 9, pierced-ear earring 200 comprises toggle 202, earpost 204 attached to the inner side of toggle 202, loop 206, an upper portion of which is positioned within perforation 208 in toggle 202, double-faced pendant 210 affixed to the lower end of loop 206, the outer face of pendant 210 being a small hexagonal faceted stone 212 and the inner face a smooth stone 214. Toggle 202 has upper end 216 and lower end 218. Arc A of a circle shows the direction of rotation of toggle 202 about the axis of earpost 204 into the position shown in FIG. 10.

Figure 10:
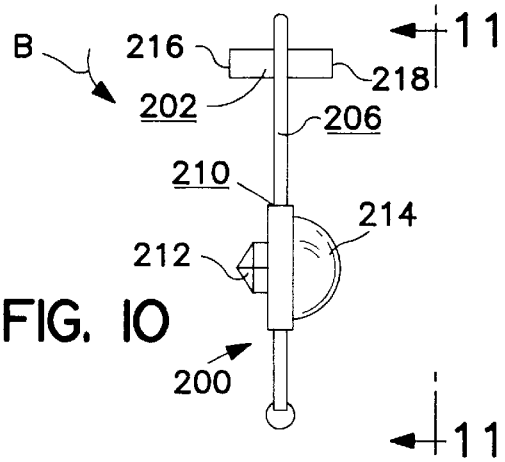
FIGS. 10 and 11 are front and side elevational views of the earring of FIGS. 8 and 9 after rotation of the toggle through 90 degrees about the axis of the earpost from the position shown in FIGS. 8 and 9.
Figure 11:
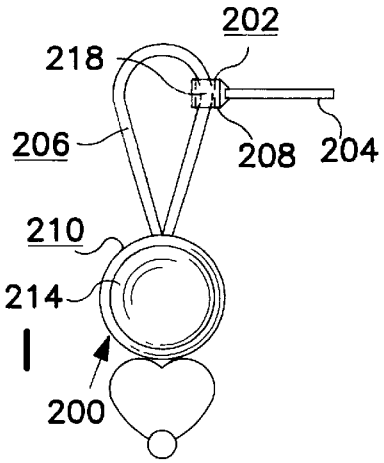

In FIGS. 10 and 11, toggle 202 of earring 200 has been rotated through 90 degrees about the axis of the earpost from the position shown in FIGS. 8 and 9, and loop 206 and pendant 210 have been rotated 90 degrees about the axis of toggle perforation 208 which is now vertical. Pendant 210 is seen edge-on and the reversal of faces 212 and 214 of pendant 210 is half complete. Arc B of a circle (FIG. 10) shows the direction of further rotation of toggle 202 about the axis of earpost 204 into the position shown in FIG. 12.

Figure 12:
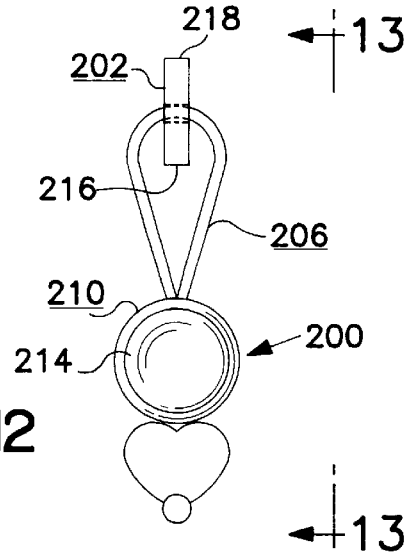
FIGS. 12 and 13 are front and side elevational views of the earring of FIGS. 8 through 11 after rotation of the toggle through 90 degrees about the axis of the earpost from the position shown in FIGS. 10 and 11.
Figure 13:
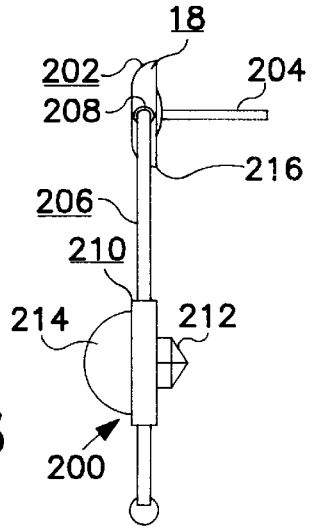

In FIGS. 12 and 13, toggle 202 of earring 200 has been rotated through an additional 90 degrees about the axis of the earpost from the position shown in FIGS. 10 and 11. Pendant 210 hangs vertically in normal wearer position from perforation 208, which is again horizontal, Smooth stone face 214 is now the outer face of pendant 210, the reversal of pendant 210 having been completed, and faceted stone face 212 is now the unseen inner face behind pendant 210.

In typical performance of the reversal method illustrated in FIGS. 8 through 13, the rotation of toggle and pendant is simultaneous, with each part rotating gradually and continually through the intermediate positions illustrated in these figures. For example, when the toggle has been rotated halfway, as shown in FIGS. 10 and 11, the loop and pendant are halfway through their rotation.

The relative positions of the loop and the toggle perforation may vary widely during the course of two simultaneous rotations, considerable latitude being available in synchronization of the toggle and pendant rotation. Each user may synchronize the rotations somewhat differently, to produce a smooth simultaneous rotation of toggle and pendant.

In the method illustrated in FIGS. 8 through 13, the ends of the toggle are reversed and the faces of the pendant are reversed from the original position of toggle and pendant. Various methods for achieving those results will be apparent in the light of the present specification.

The invention claimed is:

1. An earring comprising an earpost, a toggle having first and second sides through which a perforation passes and having a third side to which said earpost is attached, a loop of rigid material having an upper portion thereof positioned within said perforation, a pendant having first and second faces comprising non-identical ornaments, said pendant being attached to a lower portion of said loop, said loop and said pendant being rotatable about the axis of said perforation, and said earpost, toggle, loop, and pendant being rotatable as a unit about the axis of said earpost, to reverse said ornaments.

2. Method for reversing an earring, said earring comprises (a) an earpost, (b) a toggle having first and second sides through which a perforation passes and having a third side to which said earpost is attached, (c) a loop passing through said perforation, and (d) a pendant affixed to said loop and having different ornamental material on two faces thereof, said method comprising simultaneously (1) rotating said earpost, toggle, loop and pendant as a unit about the axis of said post and (2) rotating said loop and said pendant about the axis of said perforation, thereby reversing said faces of said pendant.

3. Method according to claim 2 wherein said method is performed with said earring in the ear of the wearer.

* * * * *